United States Patent [19]

White et al.

[11] Patent Number: 4,667,367

[45] Date of Patent: May 26, 1987

[54] HINGE ARRANGEMENT

[75] Inventors: Graham I. White, Southampton; Christopher J. Lynham, Eastleigh, both of England

[73] Assignee: Rittal-Werk Rudolf Loh GmbH & Co. KG, Fed. Rep. of Germany

[21] Appl. No.: 792,066

[22] Filed: Oct. 28, 1985

[30] Foreign Application Priority Data

Nov. 2, 1984 [GB] United Kingdom ..... 8427765
Feb. 15, 1985 [GB] United Kingdom ..... 8503870

[51] Int. Cl.[4] ..... E05D 7/04
[52] U.S. Cl. ..... 16/258; 16/270
[58] Field of Search ..... 16/258, 261, 270, 382, 16/DIG. 40

[56] References Cited

U.S. PATENT DOCUMENTS 3,023,451 3/1962 Thoel ..... 16/258
3,909,937 10/1975 McLean ..... 16/258
4,583,261 4/1986 Rock et al. ..... 16/382

*Primary Examiner*—M. Jordan
*Attorney, Agent, or Firm*—Renner, Otto, Boisselle & Lyon

[57] ABSTRACT

A hinge arrangement for an electrical cabinet allows a door to be rapidly removed and refitted. A hinge member, to be coupled to another hinge member by a hinge pin, is provided as a housing mounting a projecting pin and a tubular portion to be secured to a corner post of the cabinet by a wedge arrangement. A spring loaded catch engages a peripheral lip at the free end of the tubular portion when the pin is engaged in the tubular portion and moved towards the cabinet.

10 Claims, 13 Drawing Figures

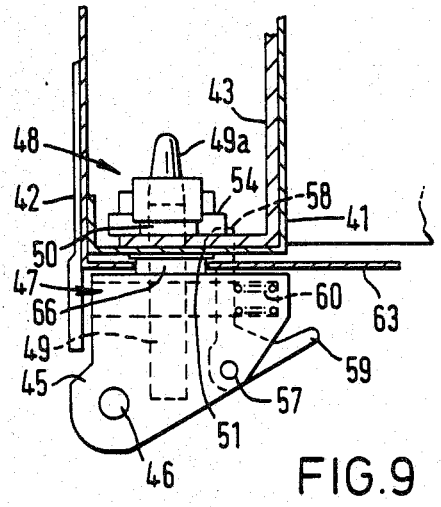
FIG.9
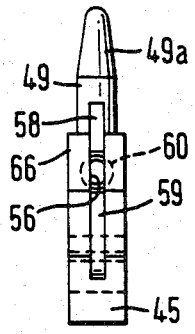
FIG. 10
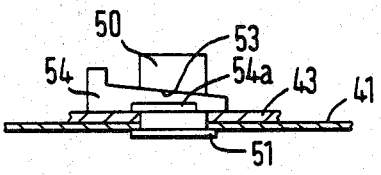
FIG.11
FIG.12
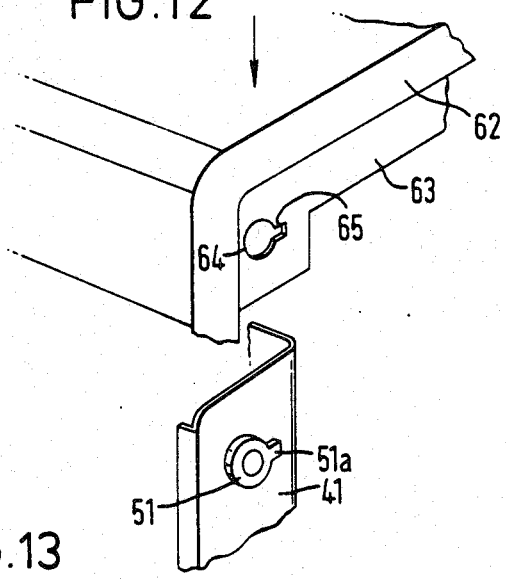
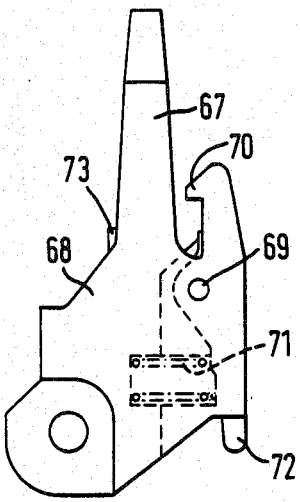
FIG.13

HINGE ARRANGEMENT

The invention relates to a hinge arrangement and particularly, though not exclusively, to a hinge arrangement for cabinets.

Cabinets frequently have pivotably openable doors, either about horizontal or vertical axes, possibly both at the front and at the rear and may comprise, for example, an electronic enclosure designed to receive subracks of electronic components.

It is frequently desirable that the or each door be readily removable and this can be done by providing upstanding hinge pins on hinge members mounted on the frame of the cabinet and tubular hinge means to engage over the pins and provided on the door. Problems arise however with engaging the pins and the tubular members of both the upper and the lower hinges simultaneously and even if one of the hinge pins is made longer than the other, so that they need not be engaged simultaneously, there is likely to be difficulty if the door is of considerable height, for example two meters. Problems also arise where the door is recessed into a surrounding rim of the frame of the cabinet, for example so that the front face of the door is flush with the surrounding rim, since the overhanging rim at the upper part of the frame prevents the door from being raised to disengage the tubular members from the hinge pins.

According to the invention there is provided a hinge arrangement comprising a pair of co-operating hinge members, the hinge members including means providing a quickly engageable connection between one of the pair of co-operating hinge members and a cabinet or a door for such a cabinet, said means comprising two components, one of said two components having a tubular portion with a peripheral lip at its free end, the other component including a projecting pin receivable in said tubular portion, and said other component further including a releasable catch means to engage the peripheral lip of the tubular portion to retain the tubular portion in engagement with the projecting pin of said other component and thus secure the two components together.

Preferably said means is provided between the cabinet and the hinge member of the pair of cooperating hinge members which is secured to the cabinet.

In one embodiment the releasable catch means comprises a pivoted catch, spring biassed into engagement with the peripheral lip of the tubular portion and a lever whereby the pivoted catch can be moved against the bias of the spring.

The tubular portion of said one component is preferably engaged in an aperture in the cabinet with a shoulder provided on the tubular portion engaged by wedge means which secure the tubular member with respect to the cabinet. The tubular portion may be secured with a peripheral flange intermediate the ends thereof abutting the front face of the cabinet or with the peripheral lip engaged against the front face of the cabinet. In the latter case a cut out to receive the pivoted catch is preferably provided in the front face of the cabinet adjacent the peripheral lip.

Preferably the bore of the tubular member is not circular but rather is elongate in at least one direction.

In another embodiment said other component has a recess therein, the tubular portion engages in the recess and the releasable catch means is provided to engage the peripheral lip of the tubular portion within the recess.

In use said one component has its tubular portion projecting from the cabinet and is secured at its other end to the cabinet by providing it to be tubular throughout its length, to have its other end engaged in an aperture in the cabinet, to have a peripheral flange intermediate its ends bearing against the outer face of the cabinet and to be screw-threaded on its outer face at said other end so as to receive a nut which can bear against the rear face of the front wall of the cabinet to secure said one component to the cabinet.

Advantageously, said other component comprises a block with a bore therein to receive a hinge pin, the block includes the recess, the projecting pin extends from within the recess to engage in the tubular portion and the releasable catch means is in the form of a plunger axially spring loaded for movement along an axis perpendicular to and intersecting the common longitudinal axis of the tubular portion, the recess and the projection.

The invention is diagrammatically illustrated by way of example in the accompanying drawings in which:

FIGS. 9, 10 and 11 show views similar to those of FIGS. 4, 7 and 8 of a third embodiment of a hinge arrangement according to the invention;

FIG. 12 shows an exploded view of a corner pillar mounting a tubular member of a hinge arrangement according to the third embodiment of the invention and a cabinet canopy; and FIG. 13 shows another embodiment of a component of a hinge of a hinge arrangement according to the invention.

Figure 1:
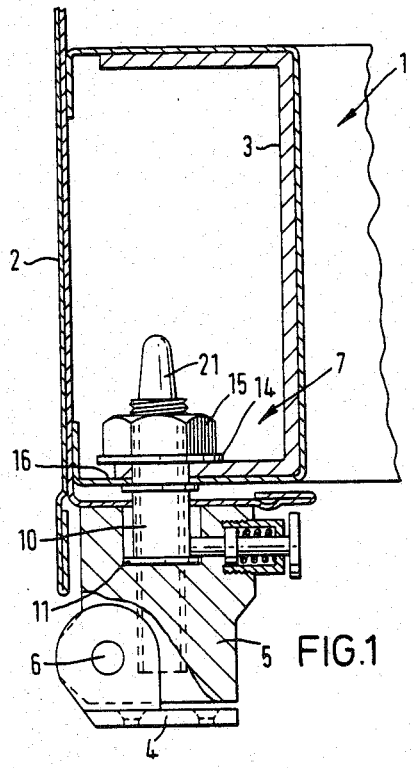
FIG. 1 is partially sectioned plan view of a corner post of a cabinet with one of a pair of cooperating hinge means secured thereto by one embodiment of a hinge arrangement according to the invention providing a quickly releasable connection.
Figure 2:
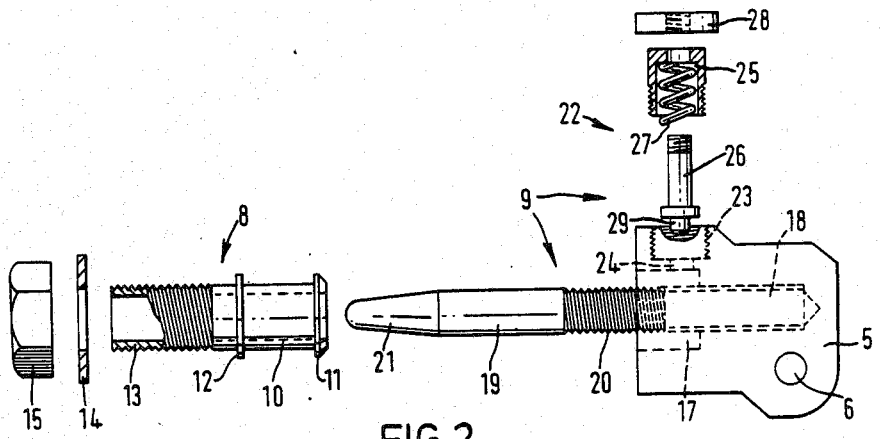
FIG. 2 is an exploded view showing the components of the hinge arrangement of FIG. 1.
Figure 4:
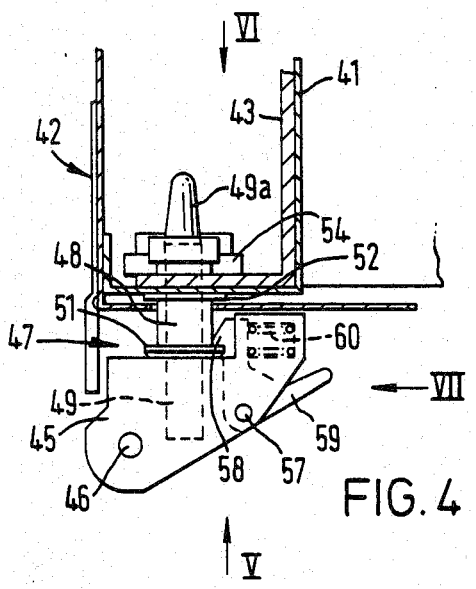
FIG. 4 is a view similar to FIG. 1 of another embodiment of a hinge arrangement according to the invention.
Figure 7:
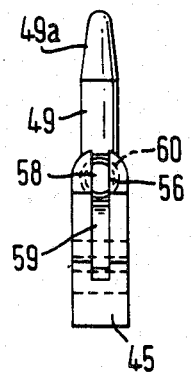
FIGS. 5, 6 and 7 are views taken respectively in the direction of arrows V, VI and VII of FIG. 4.
Figure 5:
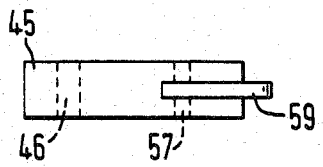

Referring to FIGS. 1 and 2, a cabinet 1 has a side panel 2 and a corner post 3 on which a door is to be mounted. The door is secured to a first hinge member 4 which is pivotably connected to a second hinge member 5 by a hinge pin 6. The hinge 4, 5, 6 is preferably one of a pair of hinges with a common hinge axis, the other not being shown.

The second hinge member 5 is secured to the corner post 3 by quickly releasable and engageable means 7.

The means 7 comprise a first component 8 permanently mounted on the corner post 3 and a second component 9 permanently mounted on the second hinge member 5. The first component 8 comprises a tubular member 10 with a lip 11 at its outer end, a peripheral flange 12 intermediate its ends and a screw thread 13 at its inner end to receive a washer 13 and nut 15. The inner end of the tubular member is engaged in an aperture 16 in the corner post 3 and secured to the corner post by the nut 15.

The second component 9 comprises a recess 17 in the second hinge member 5 with a screw threaded bore 18 at its inner end, a projection 19 with a screw threaded inner end 20, to engage permanently in the bore 18, and a tapered outer end 21 and a plunger arrangement 22. The plunger arrangement 22 comprises a screw threaded recess 23 in the second hinge member 5, a bore 24 at the inner end of the recess 23 and communicating with the recess 17, a cylinder 25 screw threaded on its outer face for permanent engagement in the recess 23, a plunger 26 and a spring 27 to be received in the cylinder 25 and an outer end disc 28 to be screwed onto the outer end of the plunger 26. The spring presses an inner end 29 of the plunger 26 through the bore 24 into the recess 17 unless the plunger 26 is pulled outwardly by a force applied to the end disc 28.

To hang a door on the cabinet it is merely necessary to engage the tapered end 21 of each hinge member 5 in the respective tubular member 10 and push the door towards the cabinet 1. The lip 11 on the outer end of the tubular member 10 cams the inner end 29 of the plunger 26 out of its path and the inner end 29 of the plunger 26 returns to engage behind the lip 11, as the lip 11 abuts the inner end of the recess 17, to secure the door. To release the door it is merely necessary to pull outwardly on the end disc 28 of the upper hinge, allow the door to tilt outwardly slightly, pull outwardly on the end disc 28 of the lower hinge and pull the door completely away from the cabinet. Hanging and release can easily be executed by one person.

To enable a door to be hung at the right side of the cabinet instead of the left side as shown, it is merely necessary to provide holes 16 in the corner post at the right side and remove the tubular members 10 from the left side, by releasing the nuts 15, and engage them at the right side, the door being inverted before it is hung.

Figure 3:
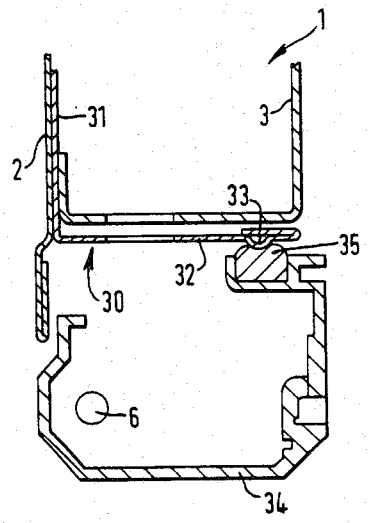
FIG. 3 is a view similar to FIG. 1 showing means for providing an electrical connection to a door mounted by a hinge arrangement according to the invention.

Referring to FIG. 3, a conductive strip 30 is formed as an angled member with a portion 31 which lies against, and is in intimate electrical contact with, the side panel 2 of the cabinet 1 and a portion 32 which extends partially across the front of the cabinet and has a projection 33 formed thereon. A frame 34 of a door, pivoted about the hinge pin 6, mounts a strip of flexible conducting material 35 which in the closed position of the door shown in FIG. 3 abuts the projection 33. Electrical connection is thus made between the side panel 2 and the door frame 34 to provide R.F. screening for the contents of the electronic enclosure quite independently of the frame 3 which could therefore if desired be made of non-conducting material. More important, it is no longer necessary to ensure that the side panel 2 and door frame 34 each make electrical contact with the frame 3. If desired the strip 30 could mount the flexible conducting strip 35 rather than mounting it on the door frame 34.

Referring to the drawings and first to FIGS. 4 to 8, a cabinet has a corner pillar 41 to which a side panel 42 is secured, the corner pillar 41 being reinforced by a reinforcing member 43 and mounting a door. The door is secured to a first hinge member not shown which is pivotably connected to a second hinge member 45 by a hinge pin 46. The hinge is preferably one of a pair of hinges with a common hinge axis, the other not being shown. The second hinge member 45 is secured to the corner pillar 41 by quickly releasable and engageable means 47.

Figure 6:
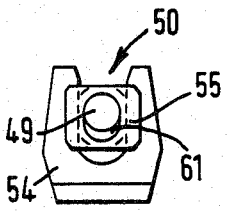
Figure 8:
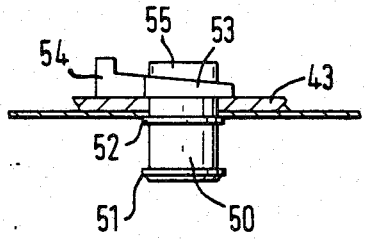
FIG. 8 shows means for securing a tubular member of the hinge arrangement of FIG. 4 in a cabinet.

The means 47 comprise a first component 48 permanently mounted on the corner pillar 41 and a second component 49 permanently mounted on the second hinge member 45. The first component 48 comprises a tubular member 50 with a peripheral lip 51 at its outer end, a peripheral flange 52 intermediate its ends and a shoulder 53 at its inner end. As can be seen in FIGS. 6 and 8, a wedge shaped member 54 co-operates with the shoulder 53 and the inside face of the reinforcing member 43 to pull the peripheral flange 52 against the outer face of the corner pillar 41 and thus secure the tubular member 50 with respect to the corner pillar 41. The inner end portion 55 of the tubular member 50 which bears the shoulder 53 is preferably of square section as can be seen in FIG. 6 and is received in a square aperture in the wall of the corner pillar 41. Barbs (not shown) are preferably provided on the faces of the wedge shaped member 54 which engage the tubular member 50 to resist undesired removal of the wedge.

The second component 49 is in the form of a pin rigidly mounted on the second hinge member 45 and having a tapered free end **49*a*. The second hinge member 45 has a slot 56 therein in which a catch member is pivotally mounted by means of a pivot pin 57, the catch member comprising a catch 58 and a release lever 59. A compression spring 60 biasses the catch 58 into engagement with the tubular member 50 comprising the first component 48 when the second component 49** is engaged therein.

As can be seen in FIG. 6 the bore 61 of the tubular member 50 is preferably not circular but rather is elongate in one direction, particularly in the direction in which the axis of the hinge pin 46 extends.

In the embodiment shown in FIGS. 9, 10, 11 and 12, in which like reference numerals denote like parts to those described with reference to FIGS. 4 to 8, the peripheral flange 52 is omitted and the peripheral lip 51 bears directly against the front face of the corner pillar 41. Upon engagement the catch 58 engages in a slot **51*a* (FIG. 12) in the front wall of the corner pillar 41 so that it can engage behind the peripheral lip 51. A recess 54*a* is provided in the front face of a middle portion of the wedge 54, as shown in FIG. 11, to accommodate the catch 58**.

To permit a canopy portion 62 of the cabinet to be assembled, by movement in the direction of the arrow in FIG. 12, so that the lower edge of its front wall 63 is below the level of the tubular member 50 but without having to leave a vertical open ended slot in its front wall 63, an aperture 64 including a recess 65 is provided in the front wall 63, through which aperture 64 and recess 65 the pin 49, a boss 66 at the front end of the second hinge member 45 and the catch 58 can project, as also shown in FIG. 9, so that the pin 49 can engage in the bore 61 of the tubular member 50 and the catch 58 can engage behind the peripheral lip 51.

The components 48 and 49 can readily be engaged and disengaged one with the other, engagement being effected merely by inserting the tapered free end **49*a* of the pin into the aperture 64 in the canopy wall 63 and the bore 61 of the tubular member 50 and pressing the second hinge member 45 towards the corner pillar 43, disengagement being effected by pulling outwardly on the lever 59 to disengage the catch 58 from the peripheral flange 52 or the peripheral lip 51 of the tubular member 50 and then pulling the second hinge member 45 outwardly away from the corner pillar 45. The tubular member 50** is preferably formed of a plastics material.

As shown in FIG. 13, the second hinge member may be formed as a forged, moulded or cast member 66 with a projecting pin 67 integral with a body 68 thereof. The catch means may be formed by a lever pivoted on a pin 69, having a catch 70 at its end adjacent which the tubular portion (not shown) will lie in the engaged position and spring 71 pressing the other end 72 of the lever away from the body 68. A stop face 73 of the body 68 is abutted by the end of the tubular portion in the engaged position.

We claim:

1. A hinge arrangement comprising a pair of co-operating hinge members, the hinge members including means providing a quickly engageable connection between one of the pair of co-operating hinge members and a cabinet or a door for such a cabinet, said means comprising two components, one of said two components having a tubular portion with a peripheral lip at its free end, the other component including a projecting pin receivable in said tubular portion and said other component further including a releasable catch means to engage the peripheral lip of the tubular portion to retain the tubular portion in engagement with the projecting pin of said other component and thus secure the two components together.

2. A hinge arrangement according to claim 1, in which the releasable catch means comprises a pivoted catch spring biassed into engagement with the peripheral lip of the tubular portion and a lever whereby the pivoted catch can be moved against the bias of the spring.

3. A hinge arrangement according to claim 1, in which the tubular portion of said one component is engaged in an aperture in the cabinet with a shoulder provided on the tubular portion engaged by wedge means which secure the tubular member with respect to the cabinet.

4. A hinge arrangement according to claim 3, in which the tubular portion is secured with a peripheral flange intermediate the ends thereof abutting the front face of the cabinet.

5. A hinge arrangement according to claim 4, in which the tubular portion is secured with the peripheral lip engaged against the front face of the cabinet.

6. A hinge arrangement according to claim 5, in which a cut out to receive the pivoted catch is provided in the front face of the cabinet adjacent the peripheral lip.

7. A hinge arrangement according to claim 1, in which the bore of the tubular member is not circular but rather is elongate in at least one direction.

8. A hinge arrangement according to claim 1, in which said other component has a recess therein, the tubular portion engages in the recess and the releasable catch means is provided to engage the peripheral lip of the tubular portion within the recess.

9. A hinge arrangement according to claim 8, in which said one component has its tubular portion projecting from the cabinet and is secured at its other end to the cabinet by providing it to be tubular throughout its length, to have its other end engaged in an aperture in the cabinet, to have a peripheral flange intermediate its ends bearing against the outer face of the cabinet and to be screw-threaded on its outer face at said other end so as to receive a nut which can bear against the rear face of the front wall of the cabinet to secure said one component to the cabinet.

10. A hinge arrangement according to claim 8, in which said other component comprises a block with a bore therein to receive a hinge pin, the block includes the recess, the projecting pin extends from within the recess to engage in the tubular portion and the releasable catch means is in the form of a plunger axially spring loaded for movement along an axis perpendicular to and intersecting the common longitudinal axis of the tubular portion, the recess and the projecting pin.

* * * * *